United States Patent [19]

Rickett et al.

[11] Patent Number: 4,791,942

[45] Date of Patent: Dec. 20, 1988

[54] PROCESS AND APPARATUS FOR THE EXPANSION OF TOBACCO

[75] Inventors: Frederic L. Rickett, Chester; Peder M. Pedersen; Eugene Glock, both of Richmond, all of Va.

[73] Assignee: The American Tobacco Company, Hopewell, Va.

[21] Appl. No.: 892,005

[22] Filed: Aug. 1, 1986

[51] Int. Cl.[4] ..... A24B 3/18

[52] U.S. Cl. ..... 131/291; 131/296; 131/900; 131/901

[58] Field of Search ..... 131/291, 296, 291, 900, 131/901

[56] References Cited

U.S. PATENT DOCUMENTS

| | | | |
|---|---|---|---|
| 3,575,178 | 4/1971 | Stewart | 131/296 |
| 4,340,073 | 6/1983 | Merritt et al. | 131/291 |
| 4,460,000 | 7/1984 | Steinberg | 131/291 |
| 4,483,352 | 11/1984 | Egri | 131/296 |
| 4,561,453 | 12/1985 | Rothchild | 131/291 |
| 4,625,736 | 12/1986 | Rothchild | 131/296 |

*Primary Examiner*—V. Millin

*Attorney, Agent, or Firm*—Pennie & Edmonds

[57] ABSTRACT

A process for expanding tobacco includes the steps of adjusting the moisture content of cut tobacco, pressurizing the cut tobacco with or without treatment, releasing the pressurized cut tobacco rapidly into a dryer and reordering the tobacco. The apparatus includes a housing having at least one chamber and preferably a chamber divided into a plurality of isolated sectors. Tobacco is received in the chamber or in each sector and released quickly from the housing following at least the step of pressurization of tobacco by steam. The apparatus may be used for batch and continuous treatment of tobacco. According to the continuous treatment, the sectors are formed by a rotating member, and each sector of the member is filled with tobacco as the member rotates relative to an inlet. The inlet and an outlet through which treated tobacco falls are in vertical alignment.

18 Claims, 2 Drawing Sheets

PROCESS AND APPARATUS FOR THE EXPANSION OF TOBACCO

DESCRIPTION

1. Technical Field

The invention relates to a process and apparatus for increasing the filling capacity of tobacco. The process may employ either batch or continuous process techniques.

2. Background Art

Harvested tobacco leaves have a moisture content which typically is reduced during curing including drying and other steps carried out on the leaf. Between the time of harvest of the tobacco leaves and their ultimate use in the manufacture of a tobacco product, the reduction in moisture content manifested by a loss in volume of the leaves may be significant. This loss in moisture content, and possibly other factors, such as the lamination of shreds of tobacco during a cutting process may result in the tobacco product having a bulk density in excess of the bulk density normally required for producing a satisfactory tobacco product.

The industry for many years has been experimenting with procedures for increasing the filling capacity of tobacco. One such procedure is disclosed by U.S. Pat. No. 3,524,452. This patent describes the treatment of tobacco with a volatile organic liquid and, then, rapidly vaporizing the organic liquid from the tobacco within a stream of gas heated to a temperature substantially above that of the boiling point of the organic liquid. Another prior art teaching is found in U.S. Pat. No. 3,683,937. This patent discloses a procedure of treating tobacco by impregnation with vapors of an organic compound or mixture of organic compounds in the absence of their liquid or solid phases. The last-mentioned patent also describes that the tobacco leaf, following impregnation, is subject to vapor releasing and expanding conditions by suddenly decreasing the ambient pressure and/or by rapidly heating the impregnated tobacco with hot gas. A further prior art teaching is that of U.S. Pat. No. 1,789,435 which discloses that tobacco in a batch technique may be placed under pressure in a pressure vessel. The pressure, then, may be released suddenly to effect expansion of tobacco.

SUMMARY OF THE INVENTION

The present invention in its principal aspect relates to increasing of the filling capacity of tobacco leaf. The invention concerns either a batch or continuous process technique, using materials which are readily available and not foreign to tobacco. In either process technique, cut tobacco having an adjusted moisture content is located to a suitable vessel, treated in the vessel with steam under pressure and, then, suddenly released from the condition of pressure into a rapidly moving, heated gas stream within a dryer. According to the invention, the filling capacity of tobacco is increased and/or further increased and fixed. Thereafter, the moisture content of the tobacco is reordered or adjusted.

In either process technique of the invention, the moisture content of the tobacco is first adjusted to between 15 and 40%, and the moisture content is finally adjusted to approximately 12%. The gas stream into which the tobacco is released is heated to a temperature of between about 300° and 800° F., and preferably about 500° F. A temperature of gas within this range will remove about 5 to 30% moisture during a single pass. The steam introduced into the vessel may be at a pressure of 5 to 300 psig and the pressure of the rapidly moving gas stream in the dryer may be at a pressure equal to, above or below atmospheric pressure.

In an alternative process technique, the tobacco in the vessel may be subjected to vacuum conditions immediately before the introduction of steam. Gases, such as carbon dioxide, in addition to steam may be used advantageously to increase the total pressure and to enhance the effect of steam on tobacco.

BEST MODE FOR CARRYING OUT THE INVENTION

The present invention concerns a process for expanding and thereby increasing the filling power of cut tobacco, utilizing either batch or continuous process techniques. Generally, the process includes the steps of treating cut tobacco during a period of time with a fluid under pressure and, then, substantially simultaneously releasing the pressure and passing the cut tobacco into a moving stream of gas at an elevated temperature. Preferably, the cut tobacco, prior to the aforementioned steps, will have had its moisture content adjusted, and this moisture content will be quickly and significantly reduced during final processing. Nevertheless, the tobacco will demonstrate an increase in filling capacity.

The process including either the batch or continuous process technique preferably is carried out with a blend of Burley and Flue-cured tobaccos, although other tobacco types, blends and by-products may be used.

Figure 1:
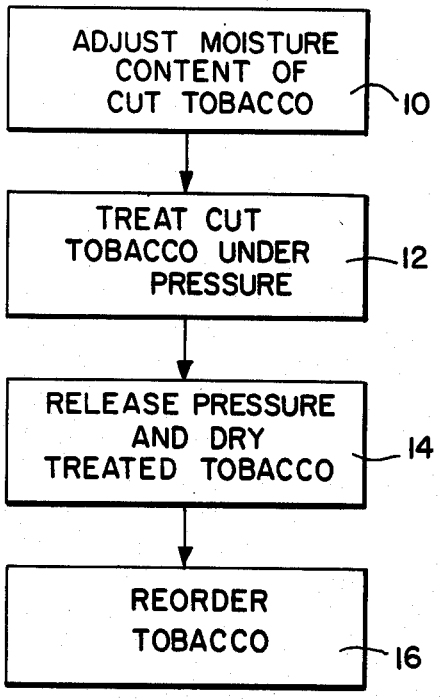
FIG. 1 is a flow diagram illustrating the several steps of the process for expanding tobacco.

The process, referring to FIG. 1, follows the steps of the flow diagram represented by blocks 10, 12, 14 and 16. As illustrated, the process includes the steps of adjustment of moisture content of the cut tobacco, treatment of the cut tobacco under pressure, release of pressure while substantially simultaneously drying the treated cut tobacco and the reordering of the tobacco.

Figure 2:
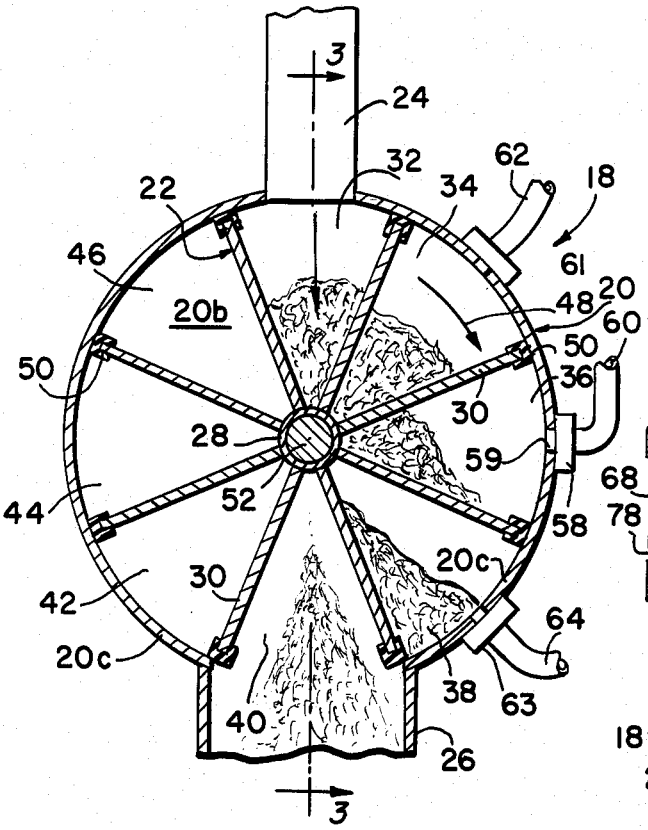
FIG. 2 is schematic presentation, in elevation and partially in section, of a rotary lock used in the continuous practice of the process of FIG. 1.
Figure 3:
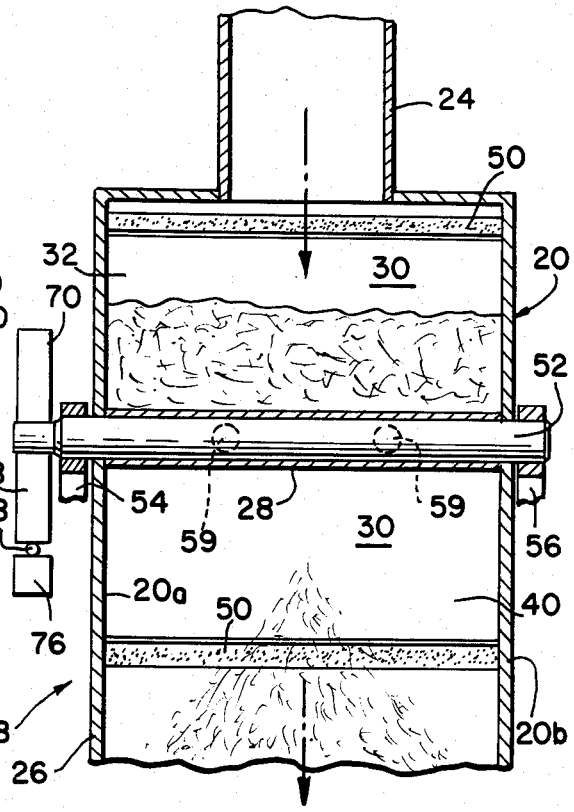
FIG. 3 is a view in section as seen along the line 3—3 in FIG. 2.
Figure 4:
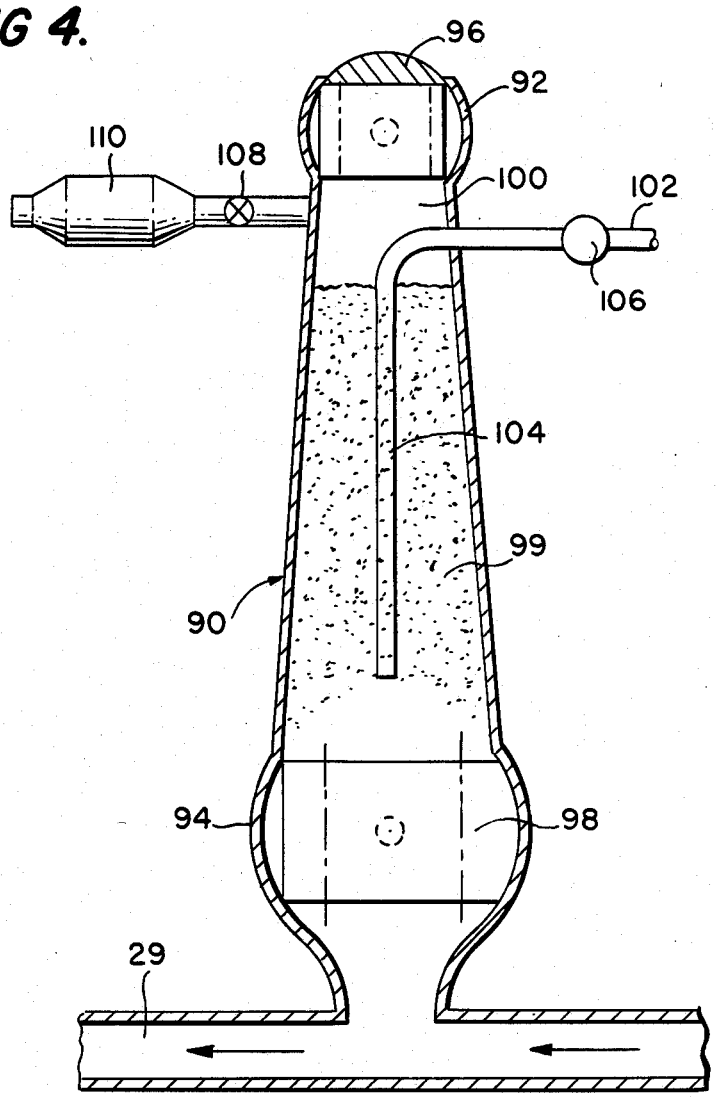
FIG. 4 is a view in elevation and partially in section of apparatus which may be used in the batch practice of the process of FIG. 1.

The process may be carried out continuously with apparatus of the type schematically illustrated in FIGS. 2 and 3. The process also may be carried out in a batch fashion with apparatus including a pressure vessel, sized to contain the amount of tobacco to be treated at the specified pressure. A typical apparatus for this purpose is schematically illustrated in FIG. 4 and will be described below. In either case, the pressure vessel is positioned directly above a dryer apparatus. Thus, as the heretofore confined tobacco passes quickly and immediately from the vessel into the dryer apparatus the pressure is released and the tobacco moisture content is quickly and significantly reduced. The primary dryer of the dryer apparatus used in the invention is a spiral type dryer capable of quickly removing from the tobacco 5 to 30% moisture during a single pass of tobacco. One type of spiral dryer that has been used successfully is the dryer manufactured by the Jetstream Corporation. The air temperature within the dryer is about 300° to 800° F. Other types of may be well known and capable of quickly removing the aforementioned moisture content in a single pass, may be used as well.

Figure 6:
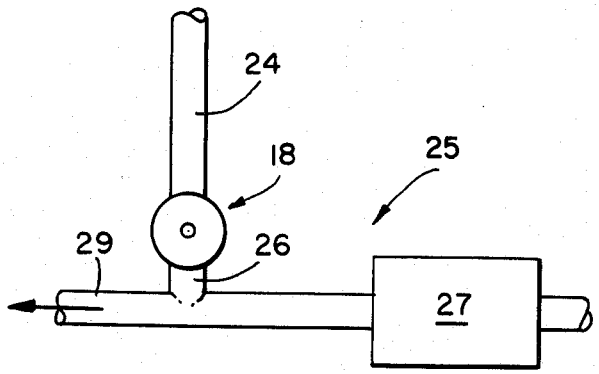
FIG. 6 is a schematic view of the rotary lock of FIGS. 2 and 3, and the relationship between an exit from the rotary lock and an inlet to a moving gas stream.

Referring to FIGS. 2, 3 and 6, apparatus for carrying out the steps 12 and 14 shown in the flow diagram of FIG. 1 includes a rotary lock 18 including a lock housing 20 of an elongated cylindrical outline. A rotary member 22 is mounted for rotation within the lock housing. The rotary lock is located in the flow path of tobacco between a duct 24 and an inlet 26 to a dryer apparatus (see FIG. 6). As illustrated in the Figure, the dryer apparatus generally denoted by the numeral 25 includes a heater 27 located in a duct 29. The heater is slightly upstream of the point of the intersection with the duct of inlet 2 through which treated tobacco is free to move. The treated tobacco will be entrained by the moving gas stream in the duct.

Although the tobacco may be conveyed to the rotary lock 18 along any particular path, preferably the rotary lock will be disposed in position so that the tobacco may be conveyed through duct 24 under the force of gravity thereby to be moved through rotation of the rotary member 22 to a location at which the tobacco falls, again under the force of gravity, into the inlet to dryer apparatus 26.

The rotary member 22 may be of any conventional configuration. For example, the rotary member may include a central core 28 and a plurality of vanes 30 extending radially outward from the core. The vanes are arranged to form a plurality of sectors 32, 34 . . . and 46. Vane rotation is in the direction of rotation of the rotary member (see arrow 48 in FIG. 2). Each of the sectors preferably are of equal size, and, as illustrated in FIG. 2, the sector 32 is initially disposed at a position of entry to the rotary lock. The sector and the tobacco it supports will move, in order, through various treating positions to a position of exit at which the treated tobacco will fall into the inlet 26 to duct 29. The various treating positions will be described but include a vacuum section (now occupied by sector 34 in FIG. 2), steam section (now occupied by sector 36), and carbon dioxide section (now occupied by sector 38).

Each vane 30 is movably sealed to housing 20 along its inner cylindrical wall thereby to isolate each individual sector from an adjacent sector. A sealing member 50 for sealing the end of each vane may be seen in FIGS. 2 and 3. The sealing members may be mounted over the end of each vane. The sealing members may be of any conventional type and formed of materials typically used to seal the space between a moving and a stationary object. For example, the sealing members each may comprise a resilient material such as rubber, neoprene, teflon or the like. Any conventional type of sealing member may be used to provide a seal along each vane, adjacent the side walls 20*a*, 20*b* (see FIG. 3) of housing 20.

A shaft 52 extends through core 28 and the walls 20*a*, 20*b* of housing 20. The shaft is keyed or otherwise secured to the core so that the shaft and core move conjointly under the control of a prime mover (not shown). A pair of journals are supported by the arms 54, 56 and, in turn, support the opposite ends of the shaft so that the shaft is capable of movement, rotationally.

Duct 24 which connects a source of tobacco to housing 20 for movement with the individual sectors may be conventional. As illustrated in FIG. 2, the duct is connected to the housing at a location at the top. The inlet 26 to the dryer apparatus may be of a construction similar to that of duct 24, and connected to the housing, at a location directly opposite. The inlet 26, however, may be larger in cross-section. In any event, inlet 26 will be of a length to at least extend between side walls 20*a*, 20*b* and the inlet will be of a width at least equal to the arcuate spacing of the ends of the vanes of adjacent pairs of vanes (see FIGS. 2 and 3). Therefore, as each sector moves into position above inlet 26 the tobacco in that sector will immediately fall by gravity and enter the inlet of the dryer apparatus.

According to the process step represented by block 12 (see FIG. 1), tobacco within an individual sector, as the sector moves sequentially in a clockwise direction from a position of entry of tobacco from duct 24, is treated by at least one medium before the tobacco leaves the sector, under gravity flow to enter inlet 26 and duct 29 of dryer apparatus 25. As illustrated, a treatment will occur at about the location now occupied by sector 36 in FIG. 2. As discussed, the tobacco also may be treated at one or both of the locations now occupied by section 34 and 38, also in FIG. 2.

An external housing provides a plenum chamber 58 in communication with the interior of the lock housing 20, and particularly within the individual sectors as they sequentially align with the plenum chamber during movement from the entry to the tobacco exit position. Communication with the individual sectors may be provided by an opening or openings 59 (see FIG. 3) through the wall 20*c* of the lock housing. The opening or openings may be of substantially any outline and size. A duct 60 is connected between the plenum chamber 58 and a source of a treating medium, such as steam.

A second external housing provides a plenum chamber 61, and yet an additional or third external housing provides a plenum chamber 63. Both the plenum chambers 61 and 63 generally duplicate plenum chamber 58, and communicate with the individual sectors in the interior of the lock housing by an opening or openings (not shown) that also duplicate the opening or openings 59. The plenum chamber 61 is located between plenum chamber 58 and duct 24, while plenum chamber 63 is located between plenum chamber 58 and the duct 26.

A duct 62 is connected between the plenum chamber 61 and a source of pressure. The source of pressure may be a source of vacuum. A duct 64 is connected between plenum chamber 63 and a source of an additional treating medium, such as carbon dioxide.

The plenum chambers are arranged in positions around the lock housing 20 so that there is no direct communication between any source and either duct 24 or duct 26. A control system to be described will control the opening and closing of a communication path between each source and plenum chamber.

Figure 5:
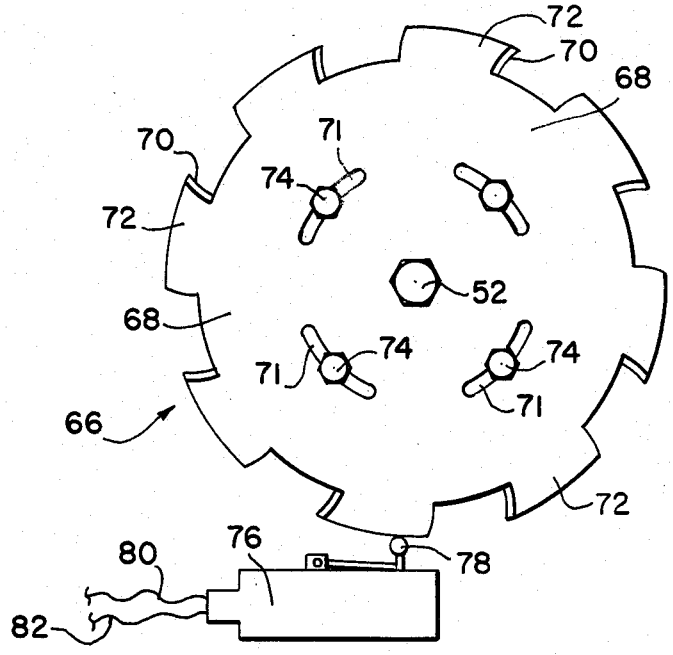
FIG. 5 is a view in elevation of an adjustable control for use with the rotary lock of FIGS. 2 and 3.

Referring to FIG. 5, there is a schematic illustration of a control system 66 for sequencing a solenoid valve controlling communication between a plenum chamber and a source. For example, the control system may function to open and close the communication path to a source of pressurized treating medium, such as steam.

The control system includes a pair of discs 68, 70, each of which are mounted on shaft 52. The discs are keyed to the shaft and, therefore, rotate at the speed of rotation of the housing 20. As illustrated, the discs are located in surface-to surface arrangement, and each disc is formed with a plurality of cam surfaces 72 at spaced locations along its perimeter.

Disc 68 includes a plurality of slots 71, each of which is located along a circle concentric with the axis of shaft 52. Disc 70 includes a like plurality of projections 74. The projections may be locking screws. The projections extend from the surface of disc 70 adjacent to disc 68 through a respective slot. By adjustment of the discs rotationally a timing operation may be either increased from a minimum timing as determined by the angular length of each cam surface 72, or decreased to the minimum length. A microswitch 76 is located adjacent the discs and cam surfaces so that a member 78 may be moved from a switch inoperative to a switch operative position to provide a sequencing function. A pair of electrical lines 80, 82 connect the microswitch in the control system.

A similar control system may be employed to open and close communication with the pressure source whereby vacuum is pulled through duct 62, and the communication with a source of carbon dioxide to be fed through duct 64. As quantities of tobacco are transported through the rotary lock, the quantities may be subjected to a pressurized steam treatment, alone, or a pressurized steam treatment with a treatment by vacuum and/or carbon dioxide.

The foregoing description is directed to a structural configuration of apparatus capable of use in continuous operation in carrying out the process of the invention. A batch technique may be used with equal facility.

Turning to FIG. 4, there is an illustration of a form of apparatus which may be used in the practice of the invention following a batch technique. The apparatus includes a vessel 90 capable of being pressurized, and having an inlet 92 for tobacco to enter the vessel and an outlet 94 for the tobacco to exit the vessel. The flow of tobacco may be by gravity flow. Thus, it is preferable to locate the inlet substantially vertically over the outlet which discharges treated tobacco into a duct, such as the duct 29 of the dryer apparatus 25. Both the inlet and outlet openings are provided with ball valves including ball valve 96 in the inlet opening and ball valve 98 in the outlet opening.

During treatment of the tobacco, as will be more particularly discussed in the Examples that follow, the tobacco mass 99 will locate within the lower portion of the vessel (a tobacco treatment portion), below a space 100 for gas.

One or more conduits 102, connected to a source of treating agent, such as steam or carbon dioxide, and a source of pressure (vacuum) extends into the vessel and downwardly of the vessel toward the outlet opening. A plurality of openings 104 are located along a conduit, preferably along the length of conduit extending within the tobacco mass for distributing the treating agent throughout the tobacco mass. A valve 106 is located in a conduit 102 to control the flow of treating agent.

A pressure release valve 108 and pressure release vent 110 are connected to the interior of the vessel for purposes of safety.

The Examples below are directed to both the batch and continuous operations of treating tobacco. The first of the Examples, Examples 1–3 describe exemplary batch operations.

Example 1

A blend of cut Burley and Flue-cured tobaccos containing 15.4% moisture was placed in a preheated pressure vessel equipped with a quick release valve on the bottom. The top of the vessel was sealed and steam was admitted to the vessel to increase the pressure to about 30 psig. The pressure condition was held for a period of 1 minute. The quick release valve was then opened, releasing tobacco and steam into the inlet of a spiral dryer. The steam treated tobacco was dried in the dryer while moving in a stream of hot gas maintained at 500° F. The tobacco had a residence time in the stream of hot gas of less than one minute and preferably about 2 to 10 seconds. A filling power of tobacco after conditioning for 5 days at 80° F. and 60% RH was found to be was 6.54 cc/g, corrected to 12.0% moisture. The filling power increase over the starting value of 5.04 cc/g was calculated at 30%.

The filling power was measured in this Example and the Examples to follow by using a 2.0 inch diameter open-top cylinder into which a 20 g sample was placed after being equilibrated at 60% RH and 80° F. A piston exerting a force of 1.5 psi pressure was applied to the sample for 3 minutes, and the volume of the sample in the cylinder was determined from a scale which relates the height of the compressed tobacco column to the filling capacity expressed as cc/g.

Example 2

A blend of cut Burley and Flue-cured tobaccos containing 15.4% moisture was placed in a preheated pressure vessel equipped with a quick release valve on the bottom. The top was sealed, steam was admitted to the vessel increasing the pressure to about 30 psig and the pressure was held for a period of 30 seconds. Carbon dioxide gas was then admitted to the vessel until the total pressure was 45 psig. This pressure was held for an additional 30 seconds. The quick release valve was then opened, releasing tobacco, steam, and carbon dioxide into the inlet of a spiral dryer. The tobacco was dried in the dryer while in a moving stream of hot gas. The gas temperature was set at 500° F., and the tobacco had a residence time in the stream of hot gas of less than one minute and preferably about 2 to 10 seconds. A filling power of tobacco after conditioning for 5 days at 80° F. and 60% RH was found to be 8.26 cc/g corrected to 12.0% moisture. This represents a 64% filling power increase over the starting value of 5.04 cc/g.

Example 3

A blend of cut Burley and Flue-cured tobaccos containing 20% moisture was placed in a preheated pressure vessel equipped with a quick release valve on the bottom. The top was sealed and the vessel was subjected to a vacuum of 5 inches of mercury for 15 seconds. The vessel was then pressurized with steam to 10 psig during 5 seconds. The quick release valve was then opened, releasing tobacco and steam into the inlet of a spiral dryer. The tobacco was dried in the dryer while moving in a moving stream of hot gas The gas temperature controller was set at 500° F. The tobacco had a residence time in the stream of hot gas of less than one minute and preferably about 2 to 10 seconds. A filling power of tobacco after conditioning for 5 days at 80° F. and 60% RH was 6.35 cc/g, corrected to 12.0% moisture. This represents a 33% increase in filling power over a starting value of 4.78 cc/g. A blend of cut Burley and Flue-cured tobaccos, also having a 20% moisture content, not treated with vacuum prior to steaming and drying was found to have a filling power of 6.19 cc/g at 12.0% moisture and a filling power increase of 29%. A similar sample blend, also having a 20% moisture content and treated with neither vacuum or steam prior to drying, was found to have a filling power of 5.71 cc/g and a filling power increase of 19%. Both of the last mentioned tobacco blends had substantially the same residence time in the stream of hot gas as first mentioned.

The following Examples describe exemplary continuous operations.

Example 4

An 18.5 pound sample of a blend of cut Burley and Flue-cured tobaccos containing 24.2% moisture was steamed in the apparatus which has been described above (hereafter rotary lock). The tobacco was supplied to each of several (the 12 o'clock position) and steam under pressure was admitted to each sector during a period of about 1.6 seconds at a second location about 90° removed. The tobacco and steam were released quickly into the inlet of a spiral dryer at a rotational position of sector directly opposite the position of entry of tobacco into the sector. The steam-treated tobacco was dried while in a moving stream of hot gas in a 3 foot diameter, 9 foot long spiral dryer built by the Jetstream Company. The gas temperature controller was set at 500° F., the rotary lock speed was 4.75 rpm, and the pressure of the steam in the lock averaged 30 psig. The tobacco feed rate was 227 pounds per hour and the tobacco had a residence time in the rotary lock of about 5 seconds. The moisture content of the tobaccos following a residence time in the stream of hot gas of less than one minute and preferably about 2 to 10 seconds was 3.2% and the filling power after conditioning the tobacco for 5 days at 80° F. and 60% RH was 7.19 cc/g, corrected to 12.0% moisture. This represents a 47% filling power increase over the starting value of 4.89 cc/g.

A second sample at the same starting moisture was treated in a similar manner except that it was not steamed in the rotary lock. Moisture content of the sample after drying under like conditions was 2.4% and the corrected filling power after conditioning was 6.88 cc/g. This represents a 41% filling power increase.

Example 5

An 18.5 pound sample of a blend of cut Burley and Flue-cured tobaccos containing 30.6% moisture was steamed in a rotary lock in the manner of Example 4 and, then, immediately dried while in a moving stream of hot gas in a spiral dryer, likewise in the manner of Example 4. The gas temperature was set at 500° F., the rotary lock speed was 4.75 rpm to provide a residence time for tobacco of about 5 seconds, the pressure of the steam in the rotary lock averaged 30 psig, and the feed rate of tobaccos was 203 pounds per hour. The moisture level of the tobaccos following a residence time in the stream of hot gas of less than one minute and preferably about 2 to 10 seconds was 4.0% and the filling power after conditioning the tobacco for 5 days at 80° F. and 60% RH was 7.63 cc/g, corrected to 12.0% moisture. This represents a 56% filling power increase over the starting value of 4.89 cc/g.

Example 6

A 120 pound sample of a blend of cut Burley and Flue-cured tobaccos having a moisture content of 37.6% was steamed in a rotary lock in the manner of Example 4 and, then, immediately dried while in a moving stream of hot gas in a spiral dryer, likewise as set out in Example 4. The gas temperature controller was set at 500° F., the rotary lock speed was 2 rpm to provide a residence time for tobacco of about 13 seconds, the pressure of the steam in the rotary lock averaged 36 psig and the feed rate of tobaccos was 277 pounds per hour. The moisture level of the tobacco following a residence time in the stream of hot gas of less than one minute and preferably about 2 to 10 seconds was 6.3%, and the corrected filling power after conditioning the tobacco for 5 days at 80° F. and 60% RH was 8.23 cc/g compared with 4.65 cc/g for the blend of tobaccos before treatment. The treated tobaccos had an increased filling power of 77% above the untreated control. Filter cigarettes manufactured from the treated expanded tobacco compared to an unexpanded control tobacco provided a yield of 120 cigarettes more per pound of tobacco or a 20% increase in yield. Table 1 demonstrates various physical properties of both the expanded and unexpanded control. Smoke analysis showed that the treatment reduced the level of "tar" and nicotine per cigarette of the expanded tobacco by 17% and 39%, respectively.

TABLE 1

| | Expanded | Unexpanded Control |
|---|---|---|
| Physical Properties | | |
| Length of cigarettes (mm) | 85.0 | 85.0 |
| Cigarettes/4 oz. | 140.0 | 110.0 |
| Weight tobacco per cigarette (grams) | 0.5970 | 0.8147 |
| Moisture (percent) | 11.9 | 12.1 |
| Firmness (mm) | 1.70 | 1.67 |
| Circumference (mm) | 24.8 | 25.0 |
| Pressure drop-tobacco column (cm) | 3.8 | 5.6 |
| Improvement in yield (percent) | 27.0 | — |
| Smoke Analysis | | |
| Length smoked (mm) | 57.0 | 58.0 |
| Puffs per cigarette | 6.0 | 8.9 |
| "Tar" (mg per cigarette) | 15.3 | 18.4 |
| "Tar" (mg per puff) | 2.1 | 2.1 |
| Nicotine (mg per cigarette) | 1.07 | 1.76 |
| Nicotine (mg per puff) | 0.18 | 0.20 |

We claim:

1. The process of expanding tobacco including the steps of
   (a) adjusting the moisture content of cut tobacco;
   (b) placing the cut tobacco in a gaseous or liquid environment consisting essentially of steam or carbon dioxide and pressurizing the cut tobacco in said environment:
   (c) substantially simultaneously depressurizing and drying the cut tobacco; and
   (d) reordering the dried tobacco.

2. The process of claim 1 wherein the cut tobacco is dried in said drying step in a stream of hot gas at a temperature of about 30° to 800° F.

3. The process of claim 2 wherein the temperature of the stream of hot gas is about 400° to 600° F.

4. The process of claim 1 wherein the cut tobacco is adjusted to a moisture content of between about 15 and 40%.

5. The process of claim 1 wherein the cut tobacco is pressurized in said pressurizing step (b) by steam to a pressure of no more than 300 psig during a period of no more than about 60 seconds.

6. The process of claim 5 including the additional step of treating the pressurized cut tobacco with carbon dioxide gas under pressure for an additional time of no more than 10 minutes to further raise the pressure of the pressurized cut tobacco.

7. The process of claim 1 including the additional step of subjecting the cut tobacco to a vacuum prior to pressurizing the cut tobacco.

8. The process of claim 6 comprising the further step of subjecting the cut tobacco to vacuum conditions prior to said pressurizing step.

9. The process of claim 1 wherein the moisture content of the dried cut tobacco is reordered to between about 10 and about 15% for use in cigarette blends in said reordering step (d).

10. The process of claim 9 wherein the tobacco has a filling power increase of at least about 30%.

11. An apparatus for the expansion of tobacco, comprising:

a housing having an interior surface defining a cylindrical chamber;

a rotatable wall structure mounted within said cylindrical chamber for rotation about the axis thereof, said rotatable wall structure comprising at least three wall elements extending substantially from the axis of said housing toward and being sealed effectively to the interior surface thereof, said wall elements being spaced substantially equally about said axis so as to divide the interior of said housing into a like number of substantially uniform chambers, so that when said rotatable wall structure is rotated about said axis said chambers are effectively rotated with respect to said housing, said housing further defining an inlet passage for supply of tobacco to one of said chambers, an outlet passage for withdrawal of tobacco from one of said chambers, and an inlet passage for supplying a pressurizing medium to one of said chambers, and wherein the sizes and locations of said inlet and outlet passages in said housing are such that only one thereof is permitted to communicate with any one of said chambers at a given time.

12. The apparatus of claim 11 wherein said housing further comprises a connection for supply of a further treatment medium to one of said chambers, the size and location of said further connection being such that it does not communicate with any one of said chambers while said chamber is in communication with any of said inlet or outlet passages.

13. The apparatus of claim 11 wherein said housing further comprises a connection for application of vacuum to one of said chambers, the size and location of said further connection being such that it does not communicate with any one of said chambers while said chamber is in communication with any of said inlet or outlet passages.

14. The apparatus of claim 11 wherein the axis of said housing is substantially horizontal and wherein said inlet passage for the supply of tobacco is located vertically above said outlet passage for the withdrawal of tobacco.

15. The apparatus of claim 11, further comprising means synchronized to the rotation of said rotatable member for control of supply of said pressurizing medium to said inlet passage therefor.

16. The apparatus of claim 15, wherein said means for control which is synchronized to the rotation of said rotatable member comprises cam means.

17. The process of claim 9 wherein said tobacco has a filling power increase of at least about 10%.

18. An improved smoking article, such as a cigarette formed of tobaccos processed according to the process of any one of claims 10 or 17.

* * * * *